United States Patent [19]

Simpson

[11] Patent Number: 4,537,528

[45] Date of Patent: Aug. 27, 1985

[54] FIREPROOF BOOM

[75] Inventor: Wayne F. Simpson, Anchorage, Ak.

[73] Assignee: Shell Oil Company, Houston, Tex.

[21] Appl. No.: 675,456

[22] Filed: Nov. 27, 1984

Related U.S. Application Data

[63] Continuation of Ser. No. 520,873, Aug. 5, 1983, abandoned.

[51] Int. Cl.[3] ..... E02B 15/04

[52] U.S. Cl. ..... 405/72; 169/50; 210/923; 405/63

[58] Field of Search ..... 405/63–72, 405/60; 210/923; 169/50

[56] References Cited

U.S. PATENT DOCUMENTS

| | | | |
|---|---|---|---|
| 2,720,269 | 10/1955 | Diacos | 169/50 |
| 3,146,598 | 9/1964 | Smith | 405/66 |
| 3,638,430 | 2/1972 | Smith | 405/66 |
| 3,756,031 | 9/1973 | Smith et al. | 405/66 |
| 3,807,177 | 4/1974 | Oberg | 405/66 |
| 4,043,131 | 8/1977 | Sessions | 405/70 |
| 4,062,191 | 12/1977 | Preus | 405/72 |
| 4,073,143 | 2/1978 | Preus | 405/72 X |
| 4,265,317 | 5/1981 | Knecht | 169/50 |
| 4,279,538 | 7/1981 | Bossa | 405/70 X |
| 4,422,797 | 12/1983 | McAllister et al. | 405/63 X |

*Primary Examiner*—Dennis L. Taylor

[57] ABSTRACT

A fireproof boom for containing flammable pollutants on water includes a flotation member, a skirt depending from the flotation member, and at least two layers of heat-resistant, water-sorbent material surrounding the flotation member. The heat-resistant, water-sorbent material draws water around the heat-sensitive flotation member, forming steam in the presence of flaming pollutant and allowing only the outer layer of heat-resistant material to become slightly singed.

6 Claims, 2 Drawing Figures

FIREPROOF BOOM

This is a continuation of application Ser. No. 520,873, filed Aug. 5, 1983, not abandoned.

BACKGROUND OF THE INVENTION

Booms are mechanical barriers which extend above and below the water surface and which are typically used to (1) enclose, contain, and concentrate spilled oil for recovery; (2) divert the oil to areas in which recovery is more easily conducted; and (3) safeguard commercially valuable or environmentally sensitive areas threatened by accidental spills or chronic pollution.

Although boom size, shape and materials vary widely according to the intended purpose of the boom, commercial booms generally consist of four basic components: (1) a means of flotation, such as a gas-filled compartment or solid float; (2) a freeboard section which extends above the water surface and prevents oil and debris from washing over the top of the boom; (3) a shirt which extends below the surface and keeps contained material from escaping beneath the boom; and (4) a tension member designed to withstand the forces of currents, waves, and winds.

Insitu burning of crude oil on water can be an extremely effective oil spill response, particularly in remote offshore areas and in broken ice where conventional countermeasures are limited. However, insitu burning is a problem insofar as the boom is concerned inasmuch as the boom may be destroyed or severely damaged by the fire. U.S. Pat. No. 4,062,191 discloses a boom wherein a fireproof fabric is utilized to reduce oil spill fire damage to the boom. However, it has been found that the temperature of burning crude oil adjacent to a boom may be at 1600° F. whereas a flameproof fabric such as cloth of woven glass fibers melts at 1100° F. and a foamed polypropylene flotation member melts at 330° F. Manifestly, more is required than simply a flameproof barrier to prevent damage to the boom.

Applicant is not aware of any other prior art which, in his judgment as one skilled in the boom art, would anticipate or render obvious the novel boom of the present invention; however, for the purposes of further developing the background of the invention and establishing the state of the requisite art, the following art is set forth: U.S. Pat. No. 4,300,856.

SUMMARY OF THE INVENTION

The primary purpose of the present invention is to provide a fireproof boom for containing a flammable pollutant on a water surface, which boom is capable of resisting the heat of adjacent burning pollutants and preventing significant damage to the boom itself. Preferably, the fireproof boom includes a heat-sensitive flotation member, a skirt depending from the flotation member, and at least two layers of heat-resistant, water-sorbent material surrounding the flotation member, said materials generating steam when exposed to the high temperatures of the burning pollutant.

Other purposes, distinctions over the art, advantages and features of the invention will be apparent to one skilled in the art upon review of the following.

DESCRIPTION OF THE PREFERRED EMBODIMENTS

Figure 2:
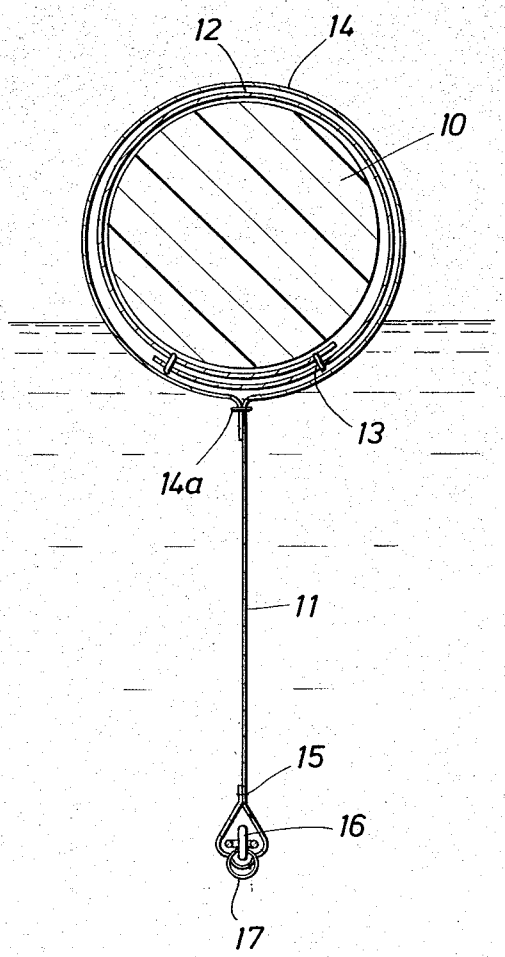
FIG. 2 discloses an end view of the boom, revealing the multiple layers of heat-resistant barrier.

As above noted, insitu burning of crude oil in water is an extremely effective oil spill response, especially in remote offshore areas and in broken ice where known countermeasures are limited. Insitu burning can be enhanced in accordance with the present invention by containing and thickening the oil with fireproof or fire resistant barriers. The present invention provides a non-metallic fire containment boom which is particularly suitable for such insitu burning.

The effectiveness of the present fire containment boom depends, in part, on the nature and amount of the oil involved, the wind, sea and ice conditions at the time of containment, and the type of platform (vessel, vehicle or aircraft) being used for deployment. During open-water conditions, the present boom can be deployed, positioned and maintained effectively from vessels. Helicopters can be used to transport the boom components to the spill site if necessary. The fire containment boom of this invention is capable of containing oil in winds, waves and currents which exceed the capacity of many conventional booms.

As ice concentrations increase, the present fire containment boom can still be used by allowing it to drift freely with the ice. If ice sizes and concentrations are such that a deflection booming cannot keep the fire containment boom free of the impact of the ice on performance, the drift mode can be used to prevent or reduce additional spreading within a heavily oiled ice field. The boom might also be positioned in a U-configuration so that wind might concentrate oil within it. As the accumulations build, pools of oil can then be ignited from the surface or from helicopters, etc. Ice concentrations well in excess of 50 percent necessitate flexibility and shallow draft. Both are features of the present boom which can be deployed on and within a heavily packed broken-ice field using helicopters, ice-strengthened tugs, etc. The present boom is used in such concentrations to supplement the existing natural containment of the ice itself.

A critical feature of the present boom is its ability to withstand extremely high temperatures of flaming pollutant, such as oil, which may burn at temperatures exceeding 1600° F., without damage to its flotation member which may be constructed of a thermally sensitive material such as foam polypropylene which melts at 330° F. or other foam plastics, or the like. Accordingly, the present invention utilizes multiple layers of heat-resistant material such as cloth of woven glass fibers, commonly known as "thermoglass", which are wrapped about the flotation member of the boom and which may depend therefrom to form a skirt below the boom. The layers of heat-resistant material must draw water around the boom and maintain itself in a wettened condition. As the heat from the flaming pollutant contacts the outer layer of heat-resistant material, steam is formed inside the layers of heat-resistant material and prevents further penetration of the heat into the boom to cause damage. Even though the outer layer of heat-resistant material may be singed by the heat of the adjacent burning pollutant, inner layers are damage free. Inspection of these inner layers immediately after a test burning is conducted reveals evidence of the formation of steam therewithin. Accordingly, it is important in the construction of the present boom to use multiple layers of heat-resistant material and to so position the layers that they may perform an osmotic wicking action to draw water from the sea up into the layers of heat-resistant material and around the flotation member, thereby positioning the water to form protective steam about the flotation member.

Having thus generally described the apparatus and method of the present invention as well as its numerous advantages over the most relevant prior art, the following is a more detailed description thereof given in accordance with specific reference to the drawings.

Figure 1:
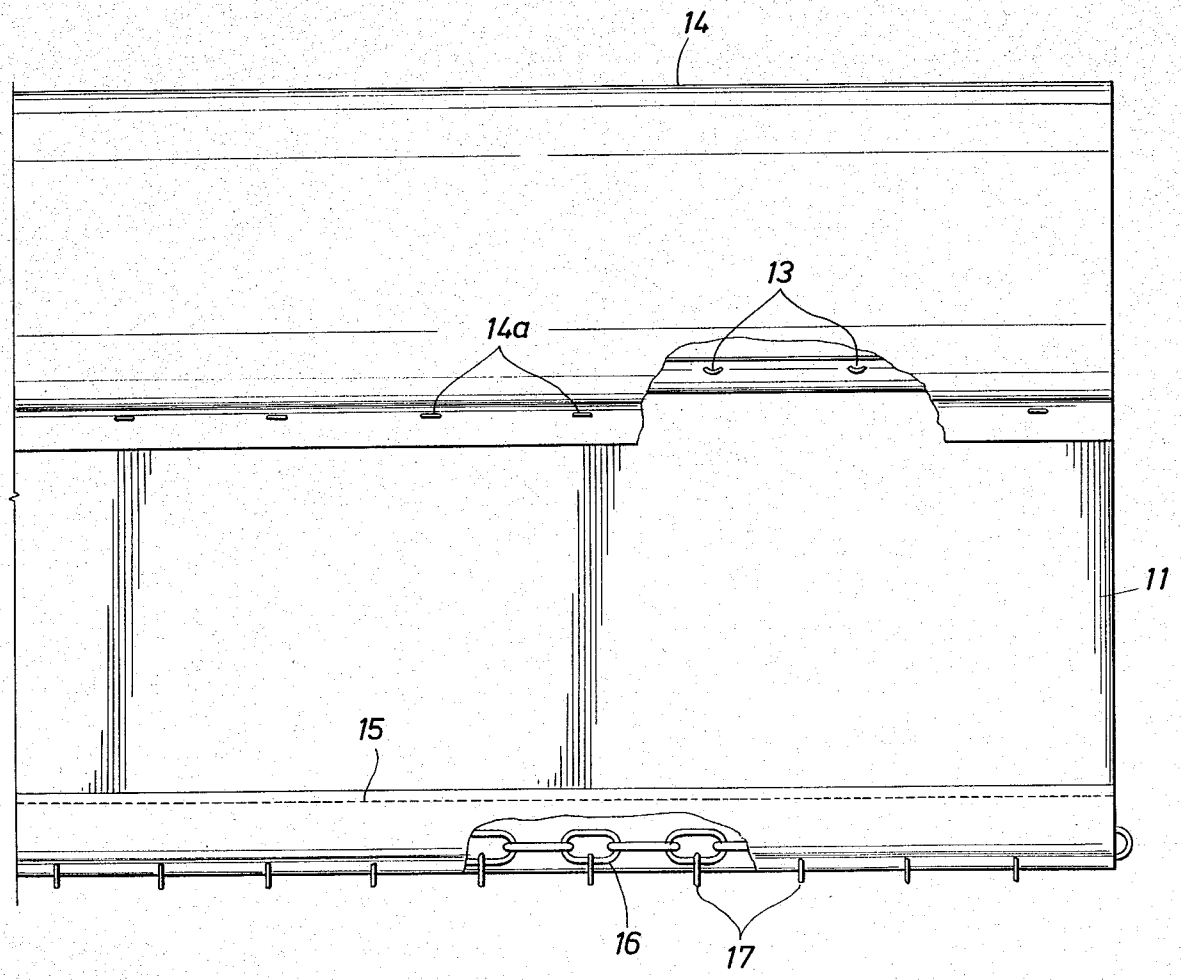
FIG. 1 discloses a side view of the boom according to the present invention.

FIGS. 1 and 2 show side and end views, respectively, of the invention. A boom comprises a number of boom sections as shown in FIG. 1. Each of the boom sections comprises a generally tubular element 10 and a depending skirt 11. The flotation element 10 comprises flotation materials such as plastic foam, cork or the like or inflatable chambers such as tubular portions constructed of a pollutant-resistant fabric or film. Preferably, flotation element 10 is constructed of plastic such as foamed polypropylene. About the flotation element 10 is a first layer of a heat-resistant, flame-resistant, non-flammable or fireproof material 12. Preferably, material 12 is woven glass fibers, e.g., a cloth sometimes referred to as "thermoglass". While the material 12 may be mounted only on the side of the boom facing the pollutant spill, it is preferred for ease of construction and other convenience that the material 12 completely encircle the flotation 10. The first layer of material 12 preferably is secured by hog rings 13 which attach it about the flotation 10. At least one more layer of material 14 is required, although it is apparent that additional layers could be used with even better results. Layer 14 preferably extends all the way around flotation 10 and is secured at the bottom of the flotation by a second set of hog rings 14. This part of the flame-resistant material, in a preferred embodiment, extends downwardly to skirt 11. It is preferable that skirt 11 likewise be of a flame-resistant or flame-retardant material although it is apparent that skirt 11 might be of other material such as sheet plastic or rubber-coated fabrics, etc. At the bottom skirt 14 is a tension member which can also double as a weighting member which keeps the bottom of the skirt depressed. Tensioning the boom from the bottom allows the flotation part of the boom to float freely without restraint, thus preventing splashover of pollutant. In a preferred embodiment, the bottom of the skirt is secured by stitching 15 to provide a loop which contains the tension member 16, preferably a chain secured with hog rings 17.

EXAMPLE

In a preferred embodiment of the invention, a fireproof non-metallic oil-containing boom is constructed in accordance with the following dimensions. The flotation is 10 inches in diameter and is provided in 10 to 150-foot sections with each section having a weight of approximately 4 pounds per foot. The flotation element is hydrophobic absorbent composed partially of polypropylene. A freeboard fabric is provided which is Amatex G70P752 DC Themoglass cloth and the skirt fabric is composed of the same material. The tension member utilized is chain which is secured at the bottom of the boom. The boom thus constructed is able to withstand burning oil-flame temperatures for extended periods of time in a salt water environment and be reusable. The boom remains flexible at low temperatures and is able to withstand frequent handling and contact with ice.

The foregoing description of the invention is merely intended to be explanatory thereof. Various changes in details of described method and apparatus may be made within the scope of the appended claims without departing from the spirit of the invention.

What is claimed is:

1. A fireproof boom for containing a flammable pollutant on a water surface comprising, a flotation member, and at least two layers of heat-resistant, water-sorbent material surrounding the flotation member and extending into the water and functionable to perform an osmotic wicking action to draw water up into the layers of the heat-resistant material and around the flotation member, thereby positioning the water to from protective steam about the flotation member upon exposure of the boom to fire.

2. The boom of claim 1 including a skirt depending from the flotation member, the skirt being an extension of the heat-resistant, water-sorbent material.

3. The boom of claim 1 wherein the skirt is weighted at its lowermost end.

4. The boom of claim 1 wherein the heat-resistant, water-sorbent material is woven glass fibers.

5. The boom of claim 1 wherein the flotation member is foamed polypropylene.

6. The boom of claim 1 including a tension member located at the lowermost end of the skirt.

* * * * *